US012195156B2

(12) United States Patent
Marsden

(10) Patent No.: US 12,195,156 B2
(45) Date of Patent: Jan. 14, 2025

(54) SHIFT INTERRUPT METHOD FOR A MARINE PROPULSION SYSTEM

(71) Applicant: Jacob Marsden, Boulder City, NV (US)

(72) Inventor: Jacob Marsden, Boulder City, NV (US)

( * ) Notice: Subject to any disclaimer, the term of this patent is extended or adjusted under 35 U.S.C. 154(b) by 404 days.

(21) Appl. No.: 17/809,970

(22) Filed: Jun. 30, 2022

(65) Prior Publication Data

US 2022/0363361 A1 Nov. 17, 2022

Related U.S. Application Data

(63) Continuation-in-part of application No. 16/554,530, filed on Aug. 28, 2019, now Pat. No. 11,401,013.

(60) Provisional application No. 62/725,125, filed on Aug. 30, 2018.

(51) Int. Cl.
*B63H 21/21* (2006.01)
*B63H 20/20* (2006.01)

(52) U.S. Cl.
CPC ..... *B63H 21/213* (2013.01); *B63H 20/20* (2013.01); *B63H 2021/216* (2013.01)

(58) Field of Classification Search
CPC . B63H 21/213; B63H 20/20; B63H 2021/216
See application file for complete search history.

(56) References Cited

U.S. PATENT DOCUMENTS

2009/0020092 A1* 1/2009 Kishibata ..... F02N 11/101 123/179.5
2017/0133138 A1* 5/2017 Bye ..... H01F 7/1615
2019/0140524 A1* 5/2019 Wolschlager ..... H02K 11/215

* cited by examiner

*Primary Examiner* — Michael C Zarroli
(74) *Attorney, Agent, or Firm* — Nolan IP Law; Jason M. Nolan

(57) ABSTRACT

A system, method, and device for interrupting power to an engine ignition coil in a marine engine during an actuation of a shift cable for transitioning between gears is provided. The method includes connecting a sensor assembly to the shift cable. The sensor assembly includes magnets, a Hall sensor for magnetic sensing, and a control circuit. The magnets are configured to pass by the Hall sensor, which senses a change in polarity of the magnets. The control circuit is configured to interrupt power to the engine ignition coil. The method includes sensing a polarity of the magnets; determining if the polarity of the magnets has changed; and sending a signal to the control circuit based on the change in polarity of the magnets, which causes an output interrupting power to the engine ignition coil.

22 Claims, 7 Drawing Sheets

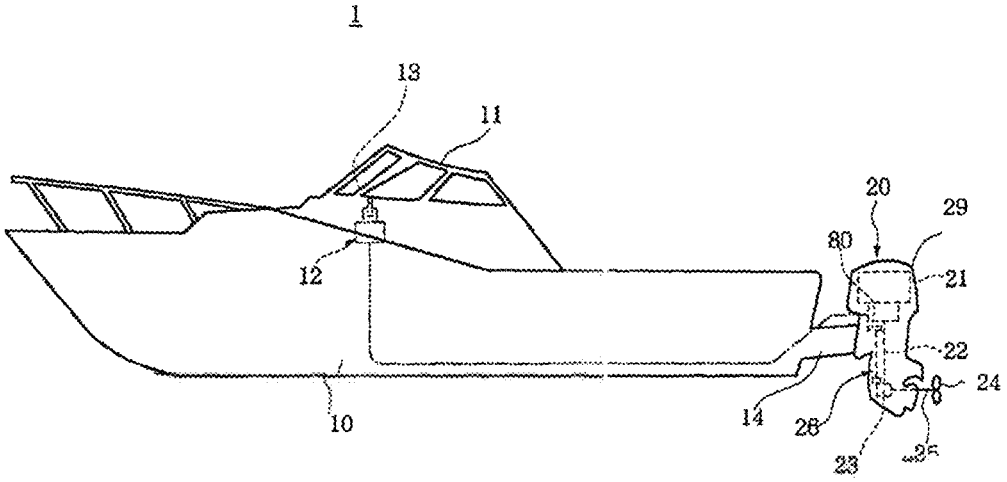
FIG. 11 - *PRIOR ART*
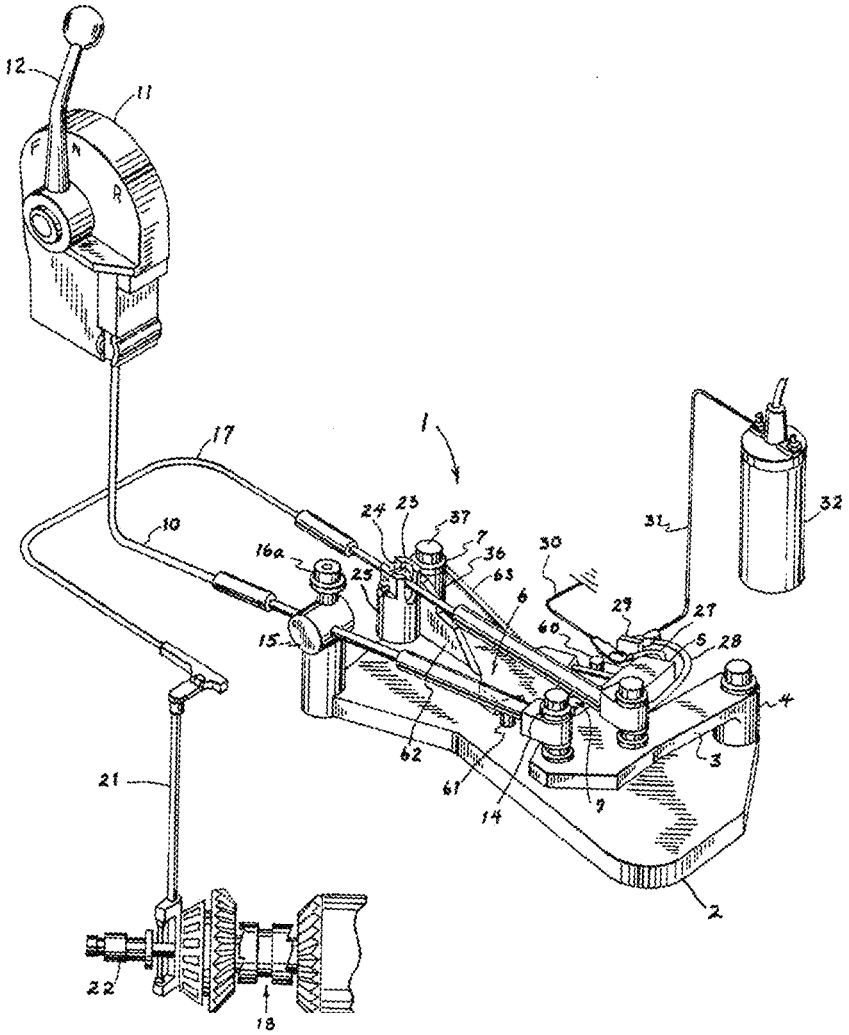
FIG. 12 - *PRIOR ART*

SHIFT INTERRUPT METHOD FOR A MARINE PROPULSION SYSTEM

CROSS-REFERENCE TO RELATED APPLICATIONS

This application is a continuation-in-part of U.S. patent application Ser. No. 16/554,530 filed on Aug. 28, 2019, the content of which is relied upon and incorporated herein by reference in its entirety, and the benefit of priority under 35 U.S.C. § 120 is hereby claimed; and, this application claims the benefit of priority under 35 U.S.C. § 119(e) of U.S. Provisional Application Ser. No. 62/725,125 filed on Aug. 30, 2018, the content of which is relied upon and incorporated herein by reference in its entirety.

FIELD

The present disclosure generally relates to marine engines, and more particularly to a device designed to retrofit a marine propulsion system and a method of using the device to facilitate a shift interrupt for the marine propulsion system.

BACKGROUND

U.S. Pat. No. 6,942,530 discloses a shift control strategy based on boat speed and engine temperature to facilitate shift. According to the patent, it is known in the art of marine propulsion systems that shifting from one gear position to another (e.g., from neutral to either forward or reverse gear) can result in impact noise and shock to the drive unit, and one method for addressing those problems is to deprive one or more cylinders of the engine from an ignition spark during the shift event.

U.S. Pat. No. 8,961,246 discloses a shift control strategy based upon position thresholds. The strategy uses a potentiometer and an analog-to-digital converter in conjunction with a micro controller. The shift control system includes a programmable control circuit and includes a microprocessor and memory.

U.S. Pat. No. 7,836,787 discloses a shift system for a boat propulsion unit. According to the patent, conventional boat propulsion units have a shift system for controlling forward, neutral, and reverse operation of a boat, the shift system including a normal turn gear and a reverse turn gear meshing with right and left sides of a drive gear coupled to a drive shaft extending from the engine. A dog clutch shift transmits the rotation of the normal or reverse gear to the propeller shaft, and a shift rod is used to slide the dog clutch to right and left directions. FIG. 1 of U.S. Pat. No. 7,836,787, showing a side view of a boat provided with a shift system for the marine engine, has been reproduced in this description as FIG. 11.

U.S. Pat. No. 9,422,047 discloses a shift system and method for facilitating shift changes in marine propulsion devices. The system and method use an idle air control and timing valve. The system and method also use a potentiometer and an analog-to-digital converter in conjunction with a micro controller. The shift control system includes a programmable control circuit and includes a microprocessor and memory. According to the patent, existing systems included the shift cable assembly disclosed in U.S. Pat. No. 4,753,618. FIG. 1 of U.S. Pat. No. 4,753,618 shows the shift cable 10 connected to a shift plate assembly comprising the switch actuating arm 6, which is attached to the shift plate 2, and the coil 32, which is also connected to the shift plate 2. FIG. 1 of U.S. Pat. No. 4,753,618 shows the remote control box 11 and the shift control arm 12, which are connected to the shift cable 10 to allow a user to switch the marine drive between a forward draft position F, a neutral position N, and a reverse drive position R. FIG. 1 of U.S. Pat. No. 4,753,618 has been reproduced in this description as FIG. 12.

U.S. Pat. No. 9,493,220 discloses a shift system that uses a potentiometer and an analog-to-digital converter in conjunction with a micro controller. According to the patent, the system includes a conventional dog clutch for actuating between forward gear, neutral gear, and reverse gear by a shift rod. The system includes an operator control lever that is a combination shift/throttle lever, which is connected to a shift linkage and shift link that translates movement of the control lever to the shift rod and marine propulsion device for causing a shift event (i.e., a change in gear) in the clutch. The shift control system includes a programmable control circuit and includes a microprocessor and memory.

U.S. Pat. No. 9,043,058 discloses a shift system having a potentiometer and an analog-to-digital converter in conjunction with a micro controller. The shift control system includes a programmable control circuit and includes a microprocessor and memory.

The above-mentioned systems generally work by interrupting the engine ignition coil to kill the engine briefly enough to allow the dog clutch to release and therefore allow a neutral gear to be achieved. These systems use a micro switch that is activated by tension exerted on the lower shift cable. This tension arises when the dog clutch is transitioning and trying to come out of gear into neutral. As a result, the above-mentioned methods can stretch the shift cable over time and eventually lead to failure, as well as requiring replacement of the cable. Additionally, the micro switches wear out and start activating erroneously, and are generally unreliable. The existing micro switch devices and methods do not interrupt the engine when transitioning from neutral into gear which causes grinding and hard shifting.

SUMMARY

In various embodiments, a method of interrupting power to an ignition coil in a marine engine during an actuation of a shift cable for transitioning between gears is provided. In some embodiments, the method can comprise the steps of: connecting a sensor assembly to the shift cable, the sensor assembly comprising magnets, a Hall sensor for magnetic sensing, and a control circuit, wherein the magnets are arranged in the sensor assembly to pass by the Hall sensor during the actuation of the shift cable; wherein the Hall sensor senses a change in polarity of the magnets; and, wherein the control circuit is configured to interrupt power to the ignition coil; sensing a polarity of the magnets; determining if the polarity of the magnets has changed; and sending a signal to the control circuit based on the change in polarity of the magnets, wherein the change in the polarity of the magnets provides an output interrupting power to the ignition coil.

In some embodiments, the output interrupting power to the ignition coil is for a duration determined by an RC time constant that is adjustable via a potentiometer.

In some embodiments, the control circuit does not use a computer or micro-controller.

In some embodiments, the sensor assembly is installed on a marine engine after-market.

In some embodiments, the Hall sensor comprises a built-in latch circuit or an external latch circuit. In some embodiments, the magnetic sensing results from a shift event in the marine engine from a neutral gear position to a forward or reverse gear. In some embodiments, the Hall sensor further senses a change in direction of the magnets.

In some embodiments, the output interrupting power to the ignition coil is implemented after the Hall sensor detects the change in polarity and direction of the passing magnets. In some embodiments, the sensing of the change in polarity of passing magnets results from a shift event in the marine engine to or from a neutral gear position to a forward or reverse gear.

In various embodiments, a shift control system for interrupting power to an ignition a coil in a marine engine during an actuation of a shift cable for transitioning between gears is provided. In some embodiments, the system can comprise: a sensor assembly comprising magnets, a Hall sensor for magnetic sensing, and a control circuit, wherein the sensor assembly is configured for attachment to the shift cable; wherein the Hall sensor senses a change in polarity of passing magnets; and wherein the Hall sensor sends a signal to the control circuit based on the change in polarity of the magnets, wherein the change in the polarity of the magnets provides an output interrupting power to the ignition coil.

In some embodiments, the output interrupting power to the ignition coil is for a duration determined by an RC time constant that is adjustable via a potentiometer. In some embodiments, the output interrupting power to the ignition coil is implemented after the Hall sensor detects a change in polarity and direction of the passing magnets.

In various embodiments, a device for interrupting power to an engine ignition coil in a marine engine during an actuation of a shift cable for transitioning between gears is provided. In some embodiments, the device comprises: a sensor assembly and a control assembly; wherein the sensor assembly comprises a Hall sensor for magnetic sensing, the Hall sensor being fixed to an inner housing and in communication with the control assembly via a first cable extending from the Hall sensor, through a first endcap of the inner housing, to the control assembly; and a magnet assembly comprising a shift arm connecting rod having an indicator and a pair of magnets fixed thereon; the shift arm connecting rod extending from a first end in proximity to the Hall sensor, slidably through a second endcap of the inner housing, to a second end fitted with a mounting head; wherein respective magnets of the pair of magnets are spaced apart from one another and positioned on either side of the Hall sensor; wherein, during the actuation of the shift cable for transitioning between gears, a respective magnet of the pair of magnets will pass by the Hall sensor as the shift arm connecting rod slides through the second endcap of the inner housing; and wherein the control assembly comprises a control circuit, a first input for receiving the first cable, and a second input for receiving a second cable extending to the engine ignition coil, the control circuit comprising a relay configured to interrupt power to the engine ignition coil during the actuation of the shift cable.

In some embodiments, the pair of magnets are arranged about the shift arm connecting rod in a predetermined pole arrangement. In some embodiments, the Hall sensor senses a change in polarity of a respective magnet of the pair of magnets. In some embodiments, the Hall sensor sends a signal to the control circuit based on the change in polarity of the respective magnet, and the relay provides an output interrupting power to the engine ignition coil based on the change in the polarity of the respective magnet.

In some embodiments, the sensor assembly further comprises an outer housing enclosing the inner housing, the outer housing having a window for observing a position of the indicator. In some embodiments, the inner housing and the outer housing each comprises a tubular structure.

In some embodiments, the control assembly further comprises a dial for adjusting the period of interrupting power delay to the engine ignition coil. In some embodiments, the control assembly further comprises third cable for drawing power from a battery. In some embodiments, the control assembly further comprises a third input for receiving a third cable connected to ground.

In some embodiments, the sensor assembly is configured for attachment to the shift cable. In some embodiments, the mounting head is configured for coupling to a shift arm of the marine engine. In some embodiments, the device further comprises a mounting bracket for coupling the sensor assembly to the marine engine.

In various embodiments, a method of attaching a device for interrupting power to an engine ignition coil in a marine engine during an actuation of a shift cable for transitioning between gears, the device comprising: a sensor assembly and a control assembly; wherein the sensor assembly comprises: a Hall sensor for magnetic sensing, the Hall sensor being fixed to an inner housing and in communication with the control assembly via a first cable extending from the Hall sensor, through a first endcap of the inner housing, to the control assembly; and a magnet assembly comprising a shift arm connecting rod having an indicator and a pair of magnets fixed thereon; the shift arm connecting rod extending from a first end positioned in proximity to the Hall sensor, slidably through a second endcap of the inner housing, to a second end fitted with a mounting head; wherein, during the actuation of the shift cable for transitioning between gears, a respective magnet of the pair of magnets passes by the Hall sensor as the shift arm connecting rod slides through the second endcap of the inner housing; and wherein the control assembly comprises a control circuit, a first input for receiving the first cable, and a second input for receiving a second cable extending to the engine ignition coil, the control circuit comprising a relay configured to interrupt power to the engine ignition coil during the actuation of the shift cable; the method comprising: providing a mounting bracket having a first through-hole configured to receive the sensor assembly of the device; inserting the sensor assembly of the device into the first through-hole of the mounting bracket; coupling the mounting head to a first bolt projecting outward from a shift plate of the marine engine; and inserting a second bolt projecting outward from the shift plate of the marine engine into a second through-hole of the mounting bracket.

It is to be understood that both the foregoing general description and the following detailed description describe various embodiments and are intended to provide an overview or framework for understanding the nature and character of the claimed subject matter. The accompanying drawings are included to provide a further understanding of the various embodiments and are incorporated into and constitute a part of this specification. The drawings illustrate the various embodiments described herein and, together with the description, explain the principles and operations of the claimed subject matter.

BRIEF DESCRIPTION OF THE DRAWINGS

A complete understanding of the present embodiments and the advantages and features thereof will be more readily understood by reference to the following detailed description, appended claims, and accompanying drawings, wherein:

FIG. 11 is a prior art illustration showing a side view of a boat provided with a shift system for a marine engine; and FIG. 12 is prior art illustration showing a schematic view of a shift cable assembly for a marine drive that incorporates a shift plate assembly having a switch actuating arm.

The drawings are not necessarily to scale, and certain features and certain views of the drawings may be shown exaggerated in scale or in schematic in the interest of clarity and conciseness.

DETAILED DESCRIPTION

Reference will now be made in detail to exemplary embodiments of the shift interrupt device. Before describing the exemplary embodiments, it is noted the embodiments reside primarily in combinations of components and procedures related to the shift interrupt device. Accordingly, the device, system, and method components have been represented where appropriate, showing only those specific details that are pertinent to understanding the embodiments of the present disclosure so as not to obscure the disclosure with details that will be readily apparent to those of ordinary skill in the art having the benefit of the description herein.

The specific details of the various embodiments described herein are used for demonstration purposes only, and no unnecessary limitation or inferences are to be understood therefrom.

In various embodiments, as shown in FIGS. 1-10, a device, system, and method of interrupting power to an engine ignition coil (EIC) in a marine engine during the actuation of a shift cable connecting the shifting lever of a remote control box with to the shift plate of a boat engine for transitioning between gears is provided. The transition between gears includes moving from the neutral gear to the forward or reverse gear, and further includes moving from the forward or reverse gear to the neutral gear. As provided herein, the interruption of power to the engine ignition coil while shifting between gears is also referred to as a shift delay.

Figure 1:
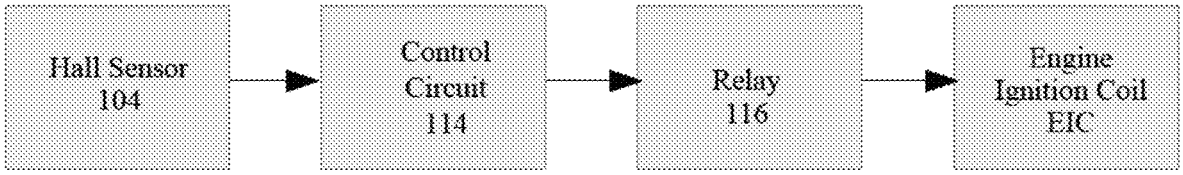
FIG. 1 is a block diagram according to embodiments described herein.

In various embodiments, as outlined in FIG. 1, a system and method of interrupting power to an engine ignition coil (EIC) in a marine engine is provided. In some embodiments, the method to input a shift delay comprises using the Hall effect sensor 104. The Hall sensor 104 may either contain a built-in latch or an external latch circuit. Shifting is implemented when the Hall sensor 104 detects a change in position and direction of a magnet passing by the Hall sensor 104. In some embodiments, as a magnet physically passes by the Hall sensor 104, a change in the magnet polarity (e.g., from north to south) is detected and the Hall sensor 104 initiates the shift delay. A subsequent change in polarity (e.g., from south to north) resets the circuit so the Hall sensor 104 is ready to be triggered again by a north to south polarity, or vice versa, depending upon the pole orientation of the magnet.

In various embodiments, a method to control and use the information obtained from the Hall sensor 104 to accurately control the time in which the power to the engine ignition coil (EIC) (e.g., component 32 in FIG. 12) is interrupted is provided. In such embodiments, the Hall sensor 104 triggers the control assembly/circuit 114/126 (e.g., One Shot monostable circuit), which then provides an output of the method, for a duration determined by an RC time constant adjusted via a potentiometer.

In various embodiments, the method to interrupt the engine ignition coil (EIC) using a specified time duration is provided. In such embodiments, the positive connection to the engine ignition coil (EIC) may be interrupted via a "normally closed" relay, MOSFET, IGBT, or solid-state equivalent. Alternatively, the engine ignition coil (EIC) may be grounded out via a "normally open" relay, MOSFET, IGBT, or solid-state equivalent.

In various embodiments, an alternative method of using a logic circuit or flip flop circuit is provided. In such embodiments, the circuit is configured to remember the last output state of the Hall sensor 104.

In various embodiments, a method comprising the ability to monitor the engine RPMs and to add or subtract capacitance or resistance in the RC time circuit to change the delay interrupt time accordingly is provided.

In existing systems, shift interrupt commands are determined by a control circuit that monitors the position of a potentiometer or the activation of a switch, and a microprocessor or computer uses such information to determine when and how long to initiate a shift interrupt. By contrast, in the embodiments described herein, the device 100 is provided for actuating a method comprising the use of the Hall sensor 104 and the magnets 106*a* and 106*b* as interrupt trigger points. In such embodiments, the placement and pole orientation of the magnets 106*a* and 106*b* will determine when to send a shift interrupt signal directly (i.e., without a microprocessor or computer). In such embodiments, the timing is adjustable by moving the magnets 106*a* and 106*b*, which are positioned on the shift arm connecting rod 108, relative to the Hall sensor 104. In some embodiments, the control circuit 126 is a RC time circuit used to control the duration of the interrupt and to activate the relay 116 (or solid state similar or equivalent).

Figure 4:
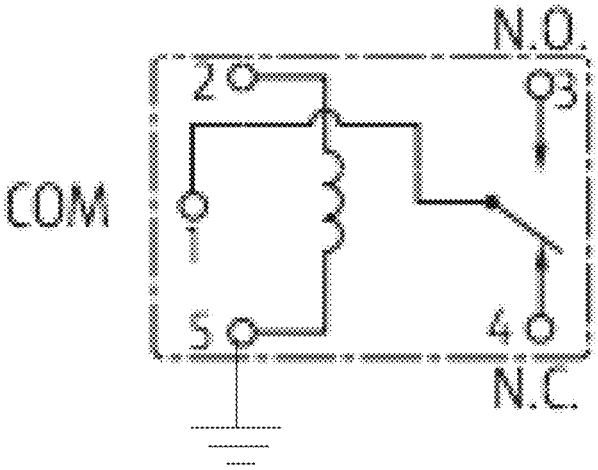
FIG. 4 is a schematic diagram of an output relay in accordance with the control circuit in FIG. 1.
Figure 5:
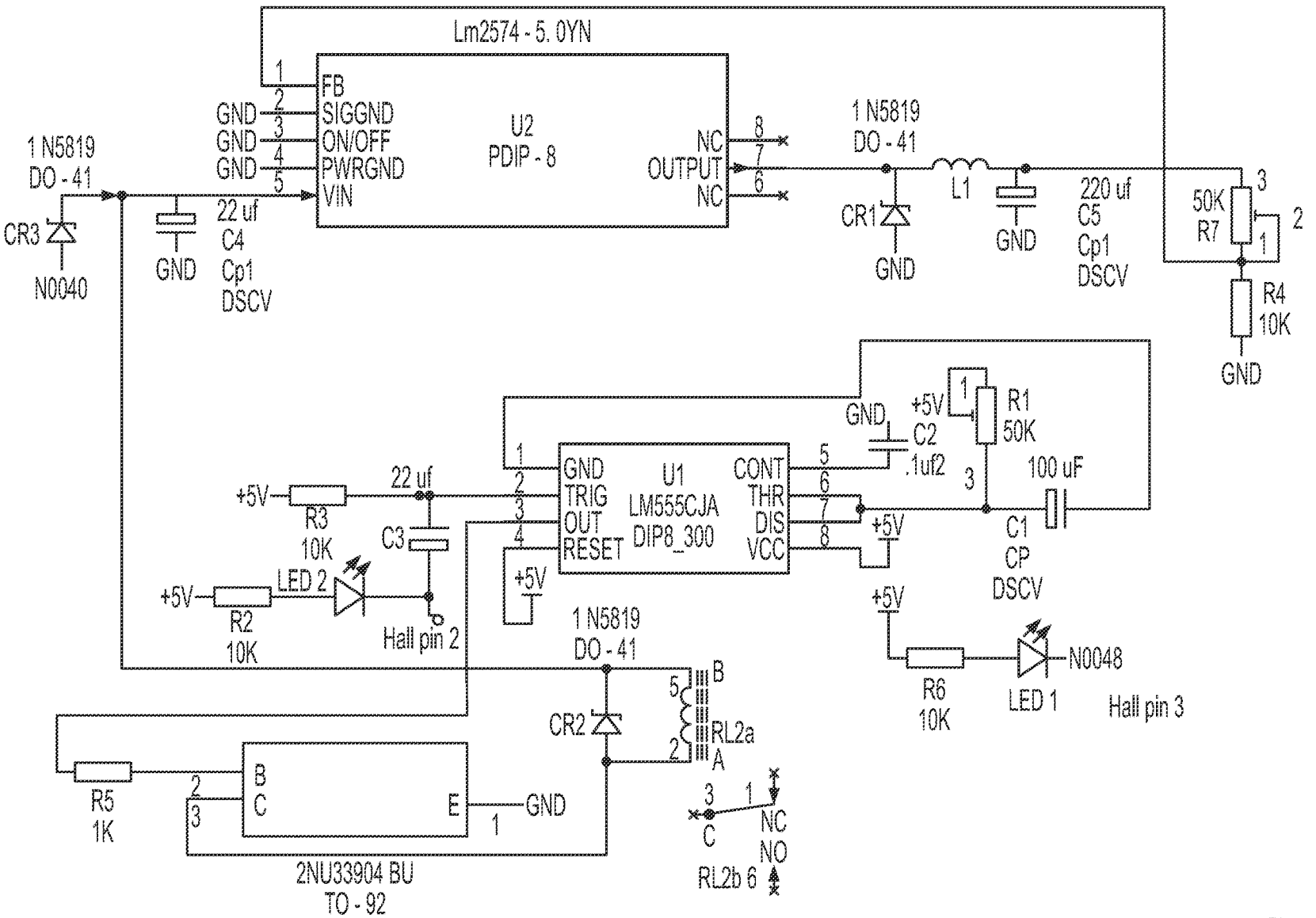
FIG. 5 is a schematic diagram of a production circuit in accordance with the control circuit in FIG. 1.

FIG. 5 is the production circuit of the various embodiments described herein. In some embodiments, the production circuit comprises features from the components described in FIGS. 2, 3, and 4, and further comprises a power supply circuit. In FIG. 5, the connection points labeled "Hall pin 2" and "Hall pin 3" refer to Hall sensor pins 2, 3 in FIG. 3.

Figure 2:
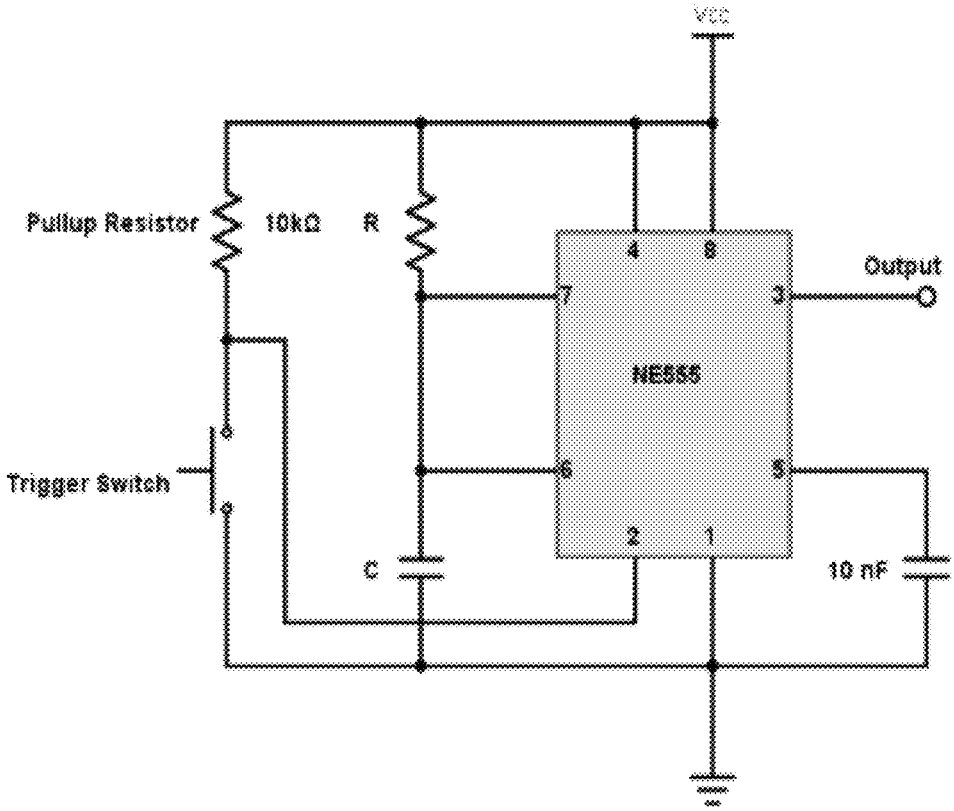
FIG. 2 is a schematic diagram of the control circuit in FIG. 1.

FIG. 2 is a schematic view of the control circuit 114 (e.g., One Shot monostable multi-vibrator). As implemented in the production circuit shown in FIG. 5, the values of R (resistance) and C (capacitance) determine the duration of the output pulse width according to the formula:

$$\text{Time}=R\times C.$$

In such embodiments, when the pin 2 in FIG. 2 detects a falling edge (i.e., a discharge by the coupling capacitor (C3 in FIG. 5) occurring after the Hall sensor 104 detects a passing magnet and indicating a change in direction), the circuit is triggered for a duration of time determined by the RC time constant.

Figure 3:
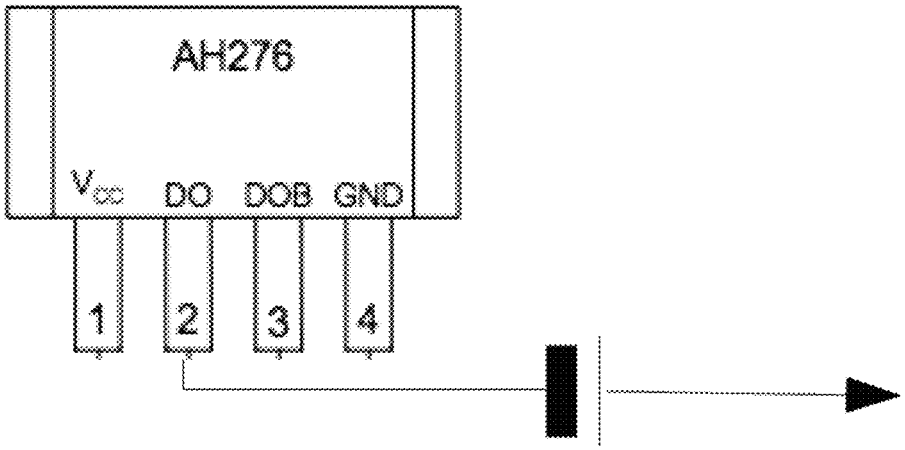
FIG. 3 is a schematic diagram of the Hall sensor trigger circuit in FIG. 1.

In some embodiments, the Hall effect sensor 104 in FIG. 3 toggles its output like a "flip flop circuit" based upon the direction of a passing magnetic field, as noted in the Data Sheet for Hall Effect Latch AH276. In some embodiments, as shown in FIGS. 6-10, the sensor assembly 102 comprises two components: the Hall sensor 104 and the magnet assembly 125 having the shift arm connecting rod 108, the indicator 110, and the magnets 106*a* and 106*b*, which are contained within the inner housing 103 and the outer housing 102. In some embodiments, the outer housing 102 comprises a window 112 for observing the position of the indicator 110. In some embodiments, the shift arm connecting rod 108 is slidable about the inner housing 103 and the outer housing 102 such that the magnets 106*a* and 106*b* are able to move past the Hall sensor 104. In some embodiments, the magnets 106*a* and 106*b* are moveable about the shift arm connecting rod 108 to adjust when the Hall sensor 104 is triggered and the length of time it is triggered for, thus implementing a shift interrupt.

Figure 8:
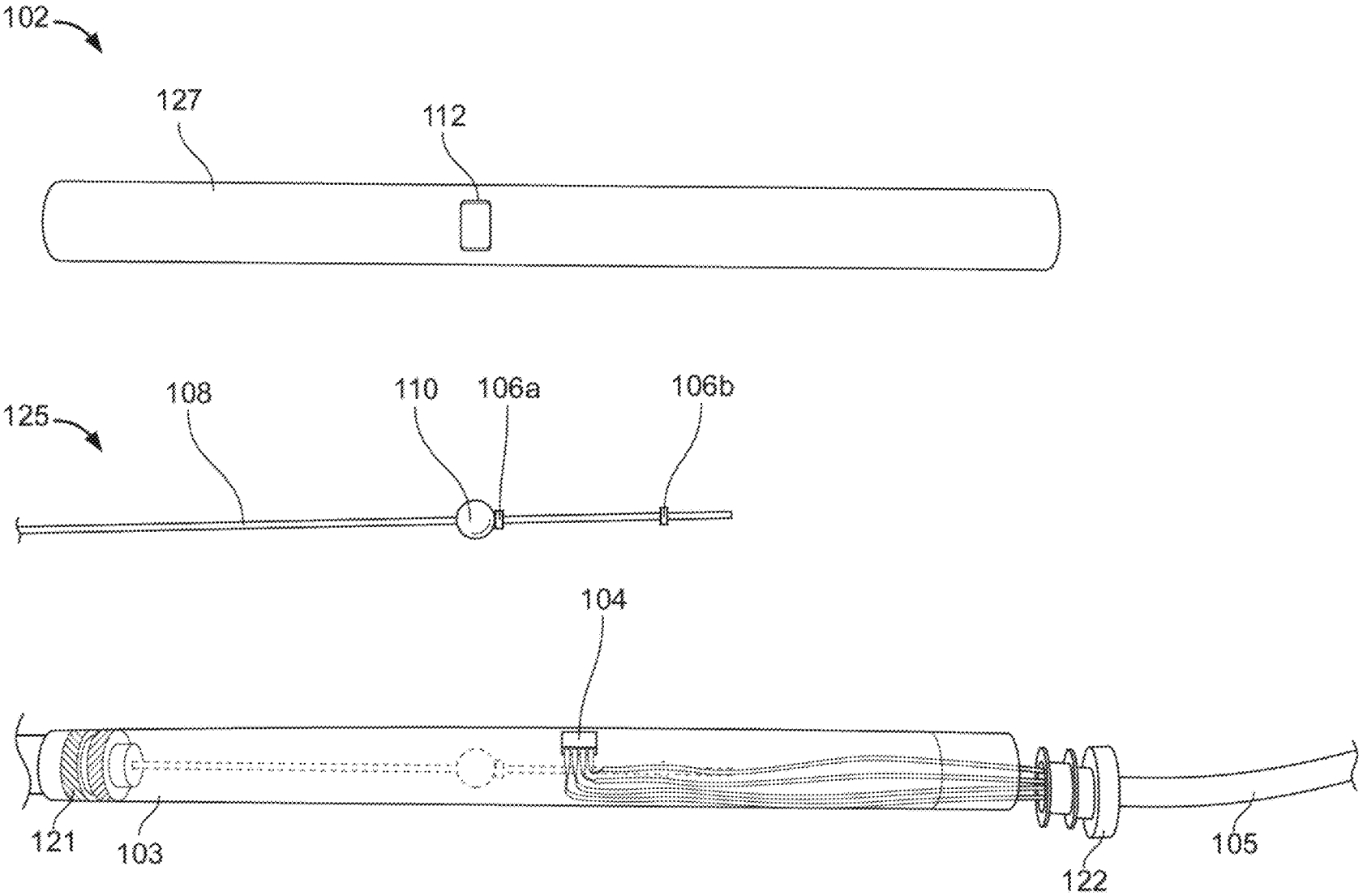
FIG. 8 is an exploded view of the sensor assembly in the shift interrupt device of FIG. 6.

In FIGS. 3 and 8, pin 2 (DO) and pin 3 (DOB) are the "toggle" outputs. As implemented in the production circuit shown in FIG. 5, when the Hall sensor 104 detects the magnet 106*a* or magnet 106*b* passing from North to South, the output at pin 2 turns on and the output at pin 3 turns off, depending on the pole orientation of the magnets. When the Hall sensor 104 detects the magnet 106*a* or magnet 106*b* passing from South to North, the output at pin 3 turns on and the output at pin 2 turns off, depending on the pole orientation of the magnets 106*a* and 106*b*. In some embodiments, the duration of the toggle output is increased.

In various embodiments, the magnets 106*a* and 106*b* are arranged about the shift arm connecting rod 108 in a particular pole arrangement. In such embodiments, a transition of magnetic poles (i.e., North to South or South to North) sensed by the Hall sensor 104 cause the sensor to toggle its output and latch. Once latched to a specific output, a transition to another direction toggles and latches to another output. This output toggle state is directly used to trigger a mono stable multivibrator circuit that has an RC time circuit that controls the time length of the shift interrupt.

FIG. 3 is a schematic view of the Hall sensor trigger circuit. As implemented in FIGS. 5, 6, 7, 9, and 10, the Hall sensor trigger circuit is substituted for the "Trigger Switch" identified in FIG. 2. In such embodiments, a passing magnetic field causes the DO output to turn on or off. In such embodiments, the DO output is coupled through the capacitor to the trigger (pin 2) shown in FIG. 2. In some embodiments, the above-described Hall sensor 104 sends its output state to pin 2 of the circuit, as shown in FIG. 3.

FIG. 4 is a schematic view of the output relay 116. As implemented in the production circuit shown in FIG. 5, the output of the One Shot monostable multi-vibrator control circuit momentarily powers pin 2 of the relay 116 coil. In such embodiments, the engine ignition coil (EIC) is interrupted by either "opening" or "closing" the relay coil's power via the COM +N.C. (normally closed, pin 4) or the COM+N.O. (normally open, pin 3) relay connections, as shown in FIG. 4.

In some embodiments, when the input (pin 2) of the 555 timer chip is lower than ⅓ of the input voltage $V_{CC}$, the Monostable circuit is triggered and provides an output at pin 3, which turns on a transistor to provide power to the output relay 116.

In some embodiments, the duration of time the relay 116 stays on is determined by the RC time constant of (C1 and R1). In such embodiments, R1 is a potentiometer, which is adjustable by the user to determine the maximum interrupt duration without stalling the engine. In such embodiments, the device described herein is advantageous because it is relatively inexpensive to make and easy to install on existing marine engines. Additional advantages include its capability to interrupt when transitioning from neutral into gear.

In some embodiments, shifting is determined by the placement of magnets 106*a* and 106*b* relative to the Hall sensor 104. When the magnets 106*a* and 106*b* are aligned properly, shifting is reliable and consistent. In such embodiments, a shift interrupt can occur when transitioning from neutral gear into forward or reverse gear, which reduces grinding and helps ensure a smooth shift. Furthermore, the embodiments described herein comprise less components to wear-out compared to existing systems because the shift interrupt device 100 is electronic and uses Hall sensors instead of a plurality of moving parts.

In various embodiments, the device and method described herein uses the cable 105 and USB connection 107 to connect the Hall sensor 104 and the control assembly 114 (and control circuit 126) to one another. In some embodiments, alternative methods of interconnection familiar to those skilled in the field of electronics may be used. In some embodiments, the Pin 2 of the Hall sensor in FIG. 2 provides an input to the monostable multivibrator control circuit in FIG. 3 via a coupling capacitor (C3 in FIG. 5). In the schematic and device, the monostable multivibrator circuit is designed using a 555 timer chip. In some embodiments, other circuits can be used. In such alternatives, the design of the monostable multivibrator using other circuits would be obvious to those skilled in the field of electronics.

In various embodiments, the circuit shown in FIG. 5, and the device 100 for implementing the same, as shown in FIGS. 6-10, are configured to retrofit existing marine systems, such as, for example, the system disclosed in U.S. Pat. No. 4,753,618 (FIG. 12), or any other system utilizing a micro switch (MS) to perform a shift interrupt. In some embodiments, the circuit shown in FIG. 5 and a device for implementing the same can be configured for new systems. In some embodiments, a shift interrupt is implemented and triggered directly from the Hall sensor 104 and the control circuit 126. Specifically, the system interrupts the engine ignition coil (EIC) when the position of the shift cable changes and causes the Hall sensor 104 to detect a change in the direction and/or width of the magnetic fields provided by the magnets 106*a* and 106*b*. In such embodiments, the magnets 106*a* and 106*b* slide by the Hall sensor 104 when the marine engine operator is shifting from one gear to another.

In various embodiments, as shown in FIGS. 1-10, the device 100 for interrupting power to an engine ignition coil (EIC) in a marine engine during an actuation of a shift cable for transitioning between gears is provided. In some embodiments, the device 100 comprises the sensor assembly 102 and the control assembly 114. In some embodiments, the sensor assembly 102 comprises the Hall sensor 104 for magnetic sensing, the Hall sensor 104 being fixed to an interior surface of the inner housing 103 and in communication with the control assembly 114 via the first cable 105 extending from the Hall sensor 104, through the endcap 122 of the inner housing 103, to the control assembly 114. In some embodiments, the magnet assembly 125, comprising the shift arm connecting rod 108 having the indicator 110 and the pair of magnets 106*a* and 106*b* fixed thereon, is provided. In such embodiments, the shift arm connecting rod 108 extends from a first end in proximity to the Hall sensor 104, slidably through the endcap 121 of the inner housing 103, to a second end fitted with the mounting head 109. In such embodiments, each of the magnets 106*a* and 106*b* are spaced apart from one another and positioned on either side of the Hall sensor 104. In such embodiments, during the actuation of the shift cable for transitioning between gears, one of the respective magnets of the pair of magnets 106*a* and 106*b* will pass by the Hall sensor 104 as the shift arm connecting rod 108 slides through the endcap 121 of the inner housing 103. In some embodiments, the control assembly 114 comprises the housing 113 and the control circuit 126, an input for receiving the first cable (not shown, but the input is configured to receive the cable 105 and connection 107 (e.g., USB)), and an input for receiving the cable 111 extending to the engine ignition coil (EIC). In some embodiments, the control circuit 126 comprises the relay 116, which is configured to interrupt power to the engine ignition coil (EIC) during the actuation of the shift cable.

In some embodiments, as shown in FIG. 8, the pair of magnets 106*a* and 106*b* are arranged about the shift arm connecting rod 108 in a predetermined pole arrangement and at a predetermined distance from one another. In some embodiments, the Hall sensor 104 senses a change in polarity of a respective magnet of the magnets 106*a* and 106*b*. In some embodiments, the Hall sensor 104 sends a signal to the control circuit 126 based on the change in polarity of the respective magnet, and the relay 116 provides an output interrupting power to the engine ignition coil (EIC) based on the change in the polarity of the respective magnet.

In some embodiments, as shown in FIG. 8, the sensor assembly 102 further comprises the outer housing 127 enclosing the inner housing 103, the outer housing 127 having the window 112 for observing the position of the indicator 110. In some embodiments, the inner housing 103 and the outer housing 127 each comprises a tubular structure. In some embodiments, the inner housing 103 is comprised of a transparent material, whereby the internal components, including the Hall sensor 104 and the magnet assembly 125 are viewable. In such embodiments, the transparent material allows the position of the indicator 110 to be viewable through the window 112 of the outer housing 127. In some embodiments, the window 112 is provided in a center portion of the outer housing 127. In such embodiments, the shift arm connecting rod 108 of the magnet assembly 125 extends through the interior space of the inner housing 103 such that the indicator is positioned in the center portion. In such embodiments, the pair of magnets 106*a* and 106*b* are positioned on either side of the Hall sensor 104. In some embodiments, a transition of magnetic poles (i.e., North to South or South to North) as the shift arm connecting rod 108 slides in and out of the inner housing 103, such that one of the magnets 106*a* or 106*b* will pass by the Hall sensor 104, causes a toggle between the Hall sensor 104 output and latch.

Figure 6:
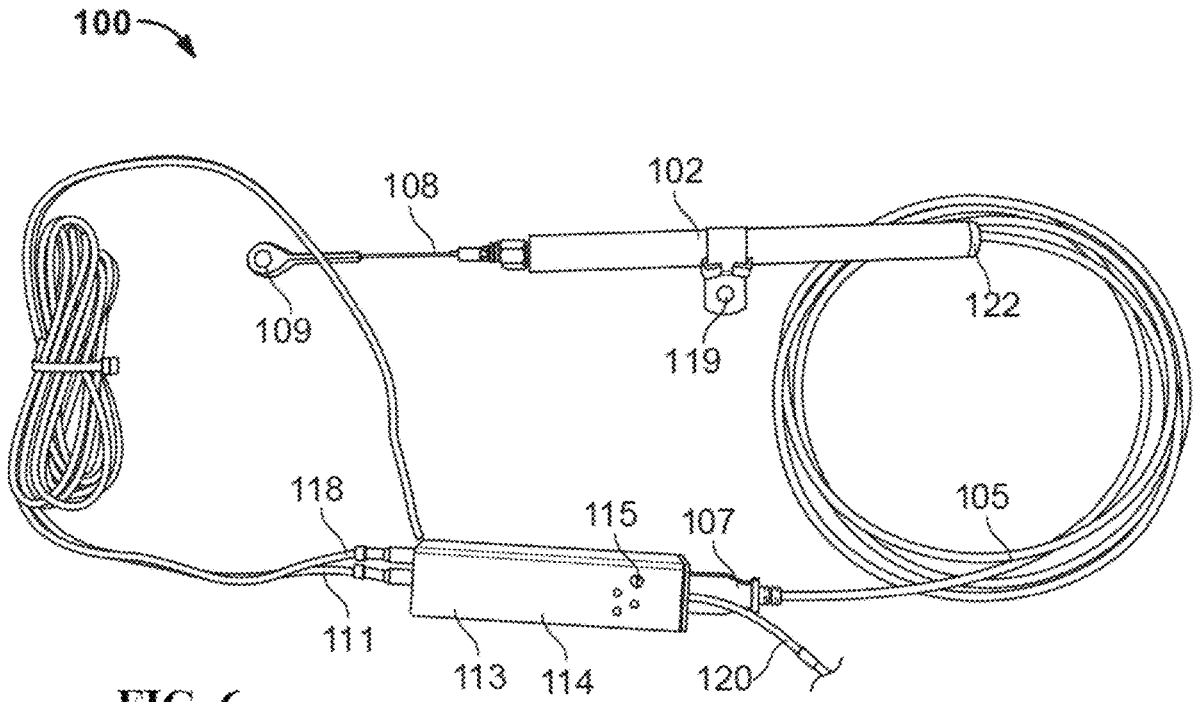
FIG. 6 is a perspective view of a shift interrupt device, in accordance with embodiments described herein.
Figure 7:
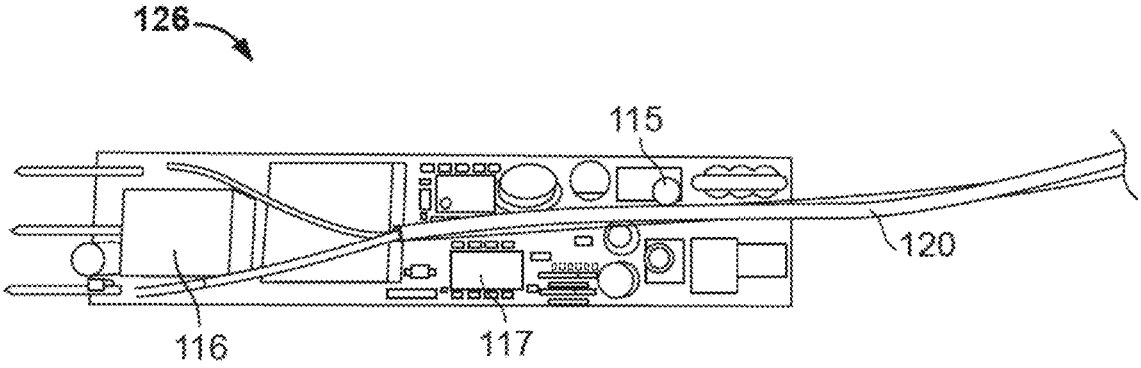
FIG. 7 is a plan view of the internal components of the control assembly in FIG. 6.

In some embodiments, as shown in FIGS. 6 and 7, the control assembly 114 further comprises the dial 115 for adjusting the period of interrupting power delay to the engine ignition coil (EIC). In some embodiments, the control assembly 114 further comprises the cable 120 for drawing power from a battery. In some embodiments, the control assembly 114 further comprises an input for receiving the cable 118, which is connected to a suitable ground.

Figure 9:
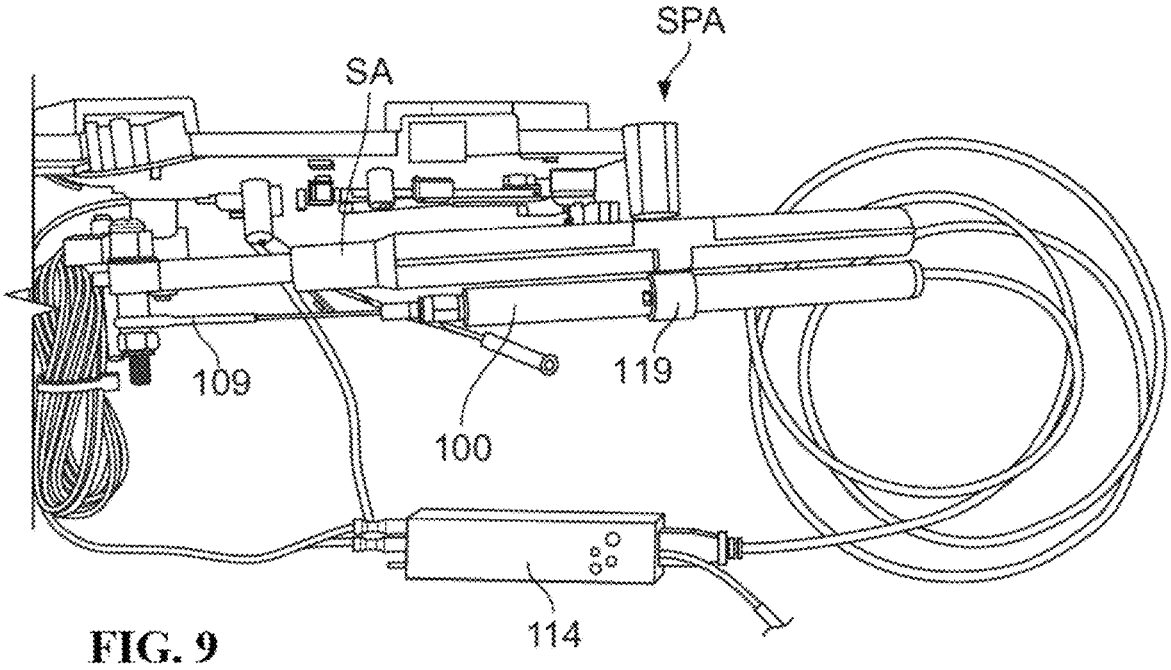
FIG. 9 is a top environmental view showing the sensor assembly of the shift interrupt device in FIG. 6 installed on the shift arm (SA) of a shift plate (SP) and shift plate assembly (SPA) of a marine engine.
Figure 10:
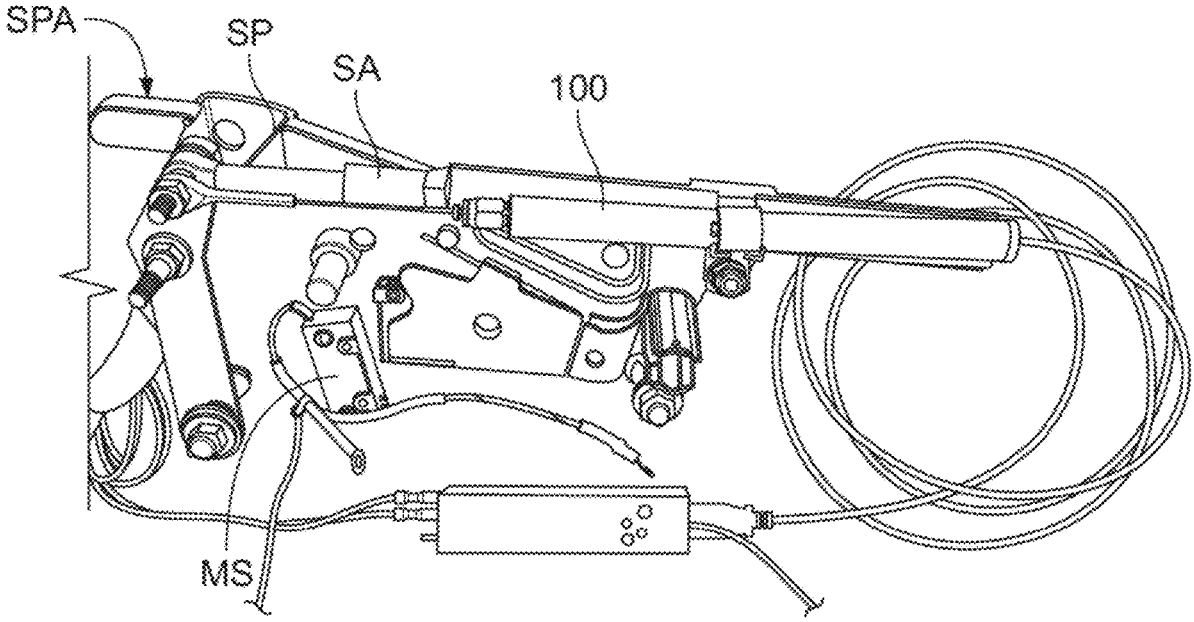
FIG. 10 is a perspective environmental view showing the sensor assembly in FIG. 6 installed on the shift arm (SA) of a shift plate (SP) and shift plate assembly (SPA) of a marine engine.

In some embodiments, as shown in FIGS. 9 and 10, the sensor assembly 102 is configured for attachment to the shift plate assembly (SPA) of a marine engine. The shift plate assembly (SPA) includes a shift plate (SP) and a shift arm (SA) that is fastened to the shift plate with a pair of bolts projecting through and outward from the shift plate (SP), as shown in FIGS. 9 and 10. In some embodiments, the mounting head 109 of the sensor assembly 102 is configured for coupling to a first bolt that holds the shift arm (SA) to the shift plate (SP) of the marine engine. In some embodiments, the device 100 further comprises the mounting bracket 119 for coupling the sensor assembly 102 to a second bolt that holds the shift arm (SA) to the shift plate (SP) of the marine engine.

The mounting bracket 119 can be any suitable mounting bracket so long as it can fasten the sensor assembly 102 to the second bolt attached to the shift plate assembly (SPA). In some embodiments, the mounting bracket 119 comprises a first through hole configured to receive the sensor assembly 102 and a second through hole for receiving a bolt projecting outward from the shift plate (SP). In some embodiments, the second through hole is threaded and sized to correspond to the bolt projecting outward from the shift plate (SP). In some embodiments, the sensor assembly 102 is coupled to the shift plate (SP) of a marine engine via a method comprising a step of inserting the sensor assembly 102 into the mounting bracket 119; coupling the mounting head 109 to a first bolt projecting outward from a shift plate (SP); and inserting the second bolt projecting outward from the shift plate (SP) into the second through-hole of the mounting bracket 119.

As used herein, the use of examples, or exemplary language (e.g., "such as"), is intended to illuminate the embodiments and does not pose a limitation on the scope of the claims unless otherwise stated. No language in the specification should be construed as indicating any non-claimed element as essential.

As used herein, the terms "about" and "substantially" will be understood by persons of ordinary skill in the art and will vary to some extent depending upon the context in which it is used. If there are uses of the term which are not clear to persons of ordinary skill in the art, given the context in which it is used, "about" and "substantially" will mean up to plus or minus 10% of the particular term.

Exemplary embodiments of the methods are described above in detail. The methods are not limited to the specific embodiments described herein, but rather, steps of the method may be utilized independently and separately from other steps described herein. All methods described herein can be performed in any suitable order unless otherwise indicated herein or otherwise clearly contradicted by context.

This written description uses examples to disclose the present embodiments, including the best mode, and also to enable any person skilled in the art to practice the present embodiments, including making and using the shift interrupt device or performing any methods. The patentable scope of the present embodiments is defined by the claims, and may include other examples that occur to those skilled in the art. Such other examples are intended to be within the scope of the claims if they have elements that do not differ from the literal language of the claims, or if they include equivalent elements with insubstantial differences from the literal language of the claims.

I claim:

1. A device for interrupting power to an engine ignition coil in a marine engine during an actuation of a shift cable for transitioning between gears, the device comprising:

a sensor assembly and a control assembly;

wherein the sensor assembly comprises:

a Hall sensor for magnetic sensing, the Hall sensor being fixed to an inner housing and in communication with the control assembly via a first cable extending from the Hall sensor, through a first endcap of the inner housing, to the control assembly; and a magnet assembly comprising a shift arm connecting rod having an indicator and a pair of magnets fixed thereon; the shift arm connecting rod extending from a first end positioned in proximity to the Hall sensor, slidably through a second endcap of the inner housing, to a second end fitted with a mounting head;

wherein, during the actuation of the shift cable for transitioning between gears, a respective magnet of the pair of magnets passes by the Hall sensor as the shift arm connecting rod slides through the second endcap of the inner housing; and wherein the control assembly comprises a control circuit, a first input for receiving the first cable, and a second input for receiving a second cable extending to the engine ignition coil, the control circuit comprising a relay configured to interrupt power to the engine ignition coil during the actuation of the shift cable.

2. The device of claim 1, wherein respective magnets of the pair of magnets are spaced apart from one another and configured to be positioned on either side of the Hall sensor when the marine engine is in a neutral gear; and wherein, during the actuation of the shift cable for transitioning between gears, each of the respective magnets are positioned on one side of the Hall sensor when the marine engine is in a forward gear or a reverse gear.

3. The device of claim 2, wherein the pair of magnets are arranged about the shift arm connecting rod in a predetermined pole arrangement.

4. The device of claim 2, wherein the Hall sensor senses a change in polarity of a respective magnet of the pair of magnets.

5. The device of claim 3, wherein the Hall sensor sends a signal to the control circuit based on the change in polarity of the respective magnet, and the relay provides an output interrupting power to the engine ignition coil based on the change in the polarity of the respective magnet.

6. The device of claim 1, wherein the sensor assembly further comprises an outer housing enclosing the inner housing, the outer housing having a window for observing a position of the indicator.

7. The device of claim 6, wherein the inner housing and the outer housing each comprises a tubular structure.

8. The device of claim 1, wherein the control assembly further comprises a dial for adjusting the period of interrupting power delay to the engine ignition coil.

9. The device of claim 1, wherein the control assembly further comprises a third cable for drawing power from a battery.

10. The device of claim 1, wherein the control assembly further comprises a fourth input for receiving a third cable connected to ground.

11. The device of claim 1, wherein the sensor assembly is configured for attachment to the shift cable.

12. The device of claim 1, wherein the mounting head is configured for coupling to a shift plate assembly of the marine engine.

13. The device of claim 1, further comprising a mounting bracket for coupling the sensor assembly to the marine engine.

14. A method of interrupting power to an ignition coil in a marine engine during an actuation of a shift cable for transitioning between gears, comprising:

providing a device comprising:

a sensor assembly and a control assembly;

wherein the sensor assembly comprises:

a Hall sensor for magnetic sensing, the Hall sensor being fixed to an inner housing and in communication with the control assembly via a first cable extending from the Hall sensor, through a first endcap of the inner housing, to the control assembly; and a magnet assembly comprising a shift arm connecting rod having an indicator and a pair of magnets fixed thereon; the shift arm connecting rod extending from a first end positioned in proximity to the Hall sensor, slidably through a second endcap of the inner housing, to a second end fitted with a mounting head;

wherein, during the actuation of the shift cable for transitioning between gears, a respective magnet of the pair of magnets passes by the Hall sensor as the shift arm connecting rod slides through the second endcap of the inner housing; and wherein the control assembly comprises a control circuit, a first input for receiving the first cable, and a second input for receiving a second cable extending to the engine ignition coil, the control circuit comprising a relay configured to interrupt power to the engine ignition coil during the actuation of the shift cable connecting the sensor assembly to the shift cable;

sensing whether the polarity of the magnets has changed; and signaling to the control circuit a change in polarity of the respective magnet, wherein the change in the polarity of the respective magnet causes the relay to output a signal for interrupting power to the engine ignition coil.

15. The method of claim 14, wherein the output signal interrupting power to the ignition coil is for a duration determined by an RC time constant that is adjustable via a potentiometer.

16. The method of claim 14, wherein the control circuit does not use a computer or micro-controller.

17. The method of claim 14, wherein the sensor assembly is connected to shift cable a marine engine after-market.

18. The method of claim 14, wherein the Hall sensor comprises a built-in latch circuit or an external latch circuit.

19. The method of claim 14, wherein the sensing results from a shift event in the marine engine from the neutral gear position.

20. The method of claim 14, wherein the Hall sensor further senses a change in direction of the respective magnet.

21. The method of claim 14, wherein the output signal for interrupting power to the engine ignition coil is implemented after the Hall sensor senses the change in polarity and direction of the respective magnet.

22. A method of attaching a device for interrupting power to an engine ignition coil in a marine engine during an actuation of a shift cable for transitioning between gears, the device comprising:

a sensor assembly and a control assembly;

wherein the sensor assembly comprises:

a Hall sensor for magnetic sensing, the Hall sensor being fixed to an inner housing and in communication with the control assembly via a first cable extending from the Hall sensor, through a first endcap of the inner housing, to the control assembly; and a magnet assembly comprising a shift arm connecting rod having an indicator and a pair of magnets fixed thereon; the shift arm connecting rod extending from a first end positioned in proximity to the Hall sensor, slidably through a second endcap of the inner housing, to a second end fitted with a mounting head;

wherein, during the actuation of the shift cable for transitioning between gears, a respective magnet of the pair of magnets passes by the Hall sensor as the shift arm connecting rod slides through the second endcap of the inner housing; and wherein the control assembly comprises a control circuit, a first input for receiving the first cable, and a second input for receiving a second cable extending to the engine ignition coil, the control circuit comprising a relay configured to interrupt power to the engine ignition coil during the actuation of the shift cable;

the method comprising:

providing a mounting bracket having a first through-hole configured to receive the sensor assembly of the device and a second through-hole configured to receive a bolt;

inserting the sensor assembly of the device into the first through-hole of the mounting bracket;

coupling the mounting head to a first bolt projecting outward from a shift plate of the marine engine; and inserting a second bolt projecting outward from the shift plate of the marine engine into a second through-hole of the mounting bracket.

* * * * *